US010441824B2

(12) United States Patent
Griffiths

(10) Patent No.: US 10,441,824 B2
(45) Date of Patent: Oct. 15, 2019

(54) DESCENDER DEVICE

(71) Applicant: Swisslogo AG, Zurich (CH)

(72) Inventor: Stephen Griffiths, Waunfawr (GB)

(73) Assignee: SWISSLOGO AG, Zurich (CH)

( * ) Notice: Subject to any disclaimer, the term of this patent is extended or adjusted under 35 U.S.C. 154(b) by 0 days.

(21) Appl. No.: 15/741,280

(22) PCT Filed: Jun. 30, 2016

(86) PCT No.: PCT/EP2016/065374
§ 371 (c)(1),
(2) Date: Jan. 1, 2018

(87) PCT Pub. No.: WO2017/001593
PCT Pub. Date: Jan. 5, 2017

(65) Prior Publication Data

US 2018/0185676 A1 Jul. 5, 2018

(30) Foreign Application Priority Data

Jul. 1, 2015 (GB) ..... 1511571.0

(51) Int. Cl.
*A62B 1/14* (2006.01)
*A63B 29/02* (2006.01)

(52) U.S. Cl.
CPC ..... *A62B 1/14* (2013.01); *A63B 29/02* (2013.01)

(58) Field of Classification Search
CPC ..... A62B 1/14
(Continued)

(56) References Cited

U.S. PATENT DOCUMENTS 666,879 A * 1/1901 White
1,087,440 A * 2/1914 Freed ..... A62B 1/14 104/113

(Continued)

FOREIGN PATENT DOCUMENTS

EP 1930624 A2 6/2008
JP 2006-345948 A 2/2006

(Continued)

OTHER PUBLICATIONS

UKIPO, Search Report dated Nov. 23, 2015 for GB Application No. 1511571.0, 3 pages.

(Continued)

*Primary Examiner* — Alvin C Chin-Shue
(74) *Attorney, Agent, or Firm* — Umberg Zipser LLP

(57) ABSTRACT

A descender device is disclosed for enabling a controlled descent of a load along a tether. The device comprises a frame having a front and rear side, and a first and second aperture disposed therein for receiving a tether. The first and second aperture extend between the front and rear side of the frame and the tether being arranged to pass between the first and second apertures substantially parallel to a longitudinal axis of the frame. The device further comprises a control bar disposed within the first aperture. The control bar extends across the first aperture and is constrained to move in a plane of the aperture, substantially transverse to a longitudinal axis of the bar. In use, the tether is arranged to loop around the control bar within the second aperture and the free ends of the tether are arranged to extend out from the first aperture, away from the front side of the frame.

12 Claims, 4 Drawing Sheets

(58) Field of Classification Search
USPC ..... 182/5
See application file for complete search history.

(56) References Cited

U.S. PATENT DOCUMENTS

| | | | | |
|---|---|---|---|---|
| 3,419,236 | A * | 12/1968 | Weber | A62B 1/06 182/5 |
| 3,695,397 | A * | 10/1972 | Hobbs | A62B 1/06 182/5 |
| 4,102,431 | A | 7/1978 | Carroll | |
| 6,971,615 | B1 * | 12/2005 | Diggle, III | F16B 45/00 182/5 |
| 9,119,978 | B1 * | 9/2015 | Bassett | A62B 1/14 |
| 2010/0116588 | A1 | 5/2010 | Bamberg | |
| 2012/0012422 | A1 | 1/2012 | Herril | |

FOREIGN PATENT DOCUMENTS

| | | | |
|---|---|---|---|
| WO | 1997-033650 | A1 | 9/1997 |
| WO | 2014-083453 | A1 | 6/2014 |

OTHER PUBLICATIONS

EPO/ISA, international search report for PCT application No. PCT/EP2016/065374, dated Sep. 28, 2016, 13 pages.

* cited by examiner

DESCENDER DEVICE

The present invention relates to a descender device for enabling controlled descent along a tether.

Devices for enabling users to descend along a rope are well-known. For example, the figure-of-eight belay device provides a convenient way of varying the friction applied to a rope when descending to limit the descent speed. The rope is wrapped around the belay device and the user can control the descent rate by varying the amount of pressure applied when gripping the rope. In the event that the user lets go of the rope, then the belay device will arrest the fall of the user.

However, the belay device, similar to other known descender devices, requires a user to positively enable the descent along the rope. If the user is otherwise unable to manipulate the rope to effect the descent, then the user can remain suspended for prolonged periods and thus become vulnerable to trauma.

We have now devised an improved descender device.

In accordance with the present invention, there is provided a descender device for enabling a controlled descent along a tether, the device comprising a frame having a front and rear side, the frame comprising a first and second aperture disposed therein for receiving a tether, the first and second apertures extending between the front and rear side of the frame, the tether being arranged to pass between the first and second apertures substantially parallel to a longitudinal axis of the frame, the device further comprising a control bar disposed within the second aperture, the control bar extending across the second aperture and constrained to move in a plane of the second aperture, substantially transverse to a longitudinal axis of the bar, wherein in use, the tether is arranged to loop around the control bar within the second aperture and the free ends of the tether are arranged to extend out from the first aperture, away from the front side of the frame.

In an embodiment, the device further comprises a control member for limiting the extent to which the control bar can slide along the second aperture. Preferably, the control member is slidably coupled to the frame. The control member is coupled to the frame at the rear side thereof.

In an embodiment, the control bar is arranged to control the rate at which the tether can pass between the first and second apertures and comprises a plurality of protuberances at a first side thereof, which are arranged to grip the tether between the control bar and a side of the second aperture. Preferably, the first side of the control bar faces the first aperture. The control bar further comprises a second side which faces away from the first aperture, the second side comprising a curved surface.

In an embodiment, the device further comprises a first and second gate disposed proximate the first and second apertures, respectively. The first and second apertures are disposed longitudinally of the frame between the first and second gates. Preferably, the first and second gates are disposed at a front side of the frame and are arranged to separately receive one end of the tether.

In an embodiment, the first and second apertures are disposed upon the longitudinal axis of the frame.

In an embodiment, the device further comprises a support aperture for coupling the device to a load to be supported.

Embodiments of the present invention will now be described by way of example only and with reference to the accompanying drawings in which.

Figure 1:
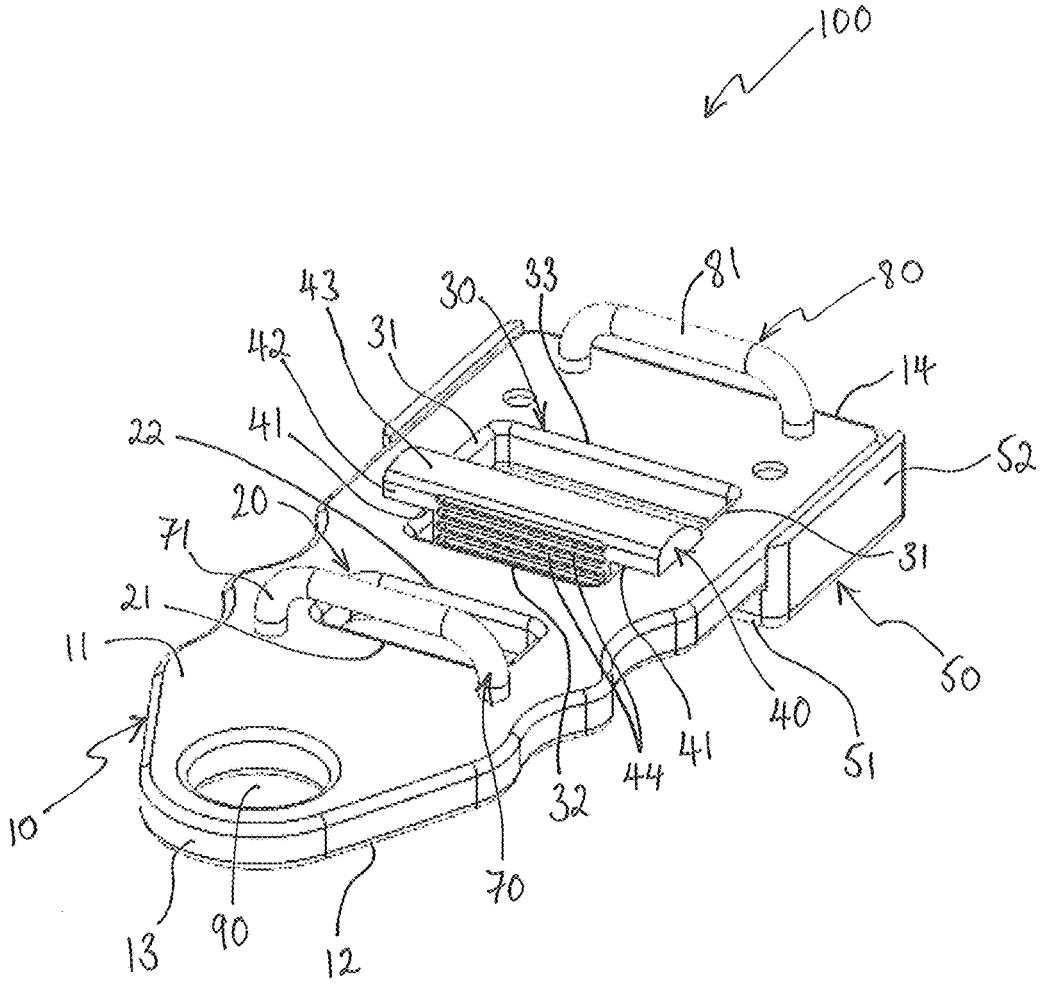
FIG. 1 is perspective view of the descender device according to an embodiment of the present invention.
Figure 3:
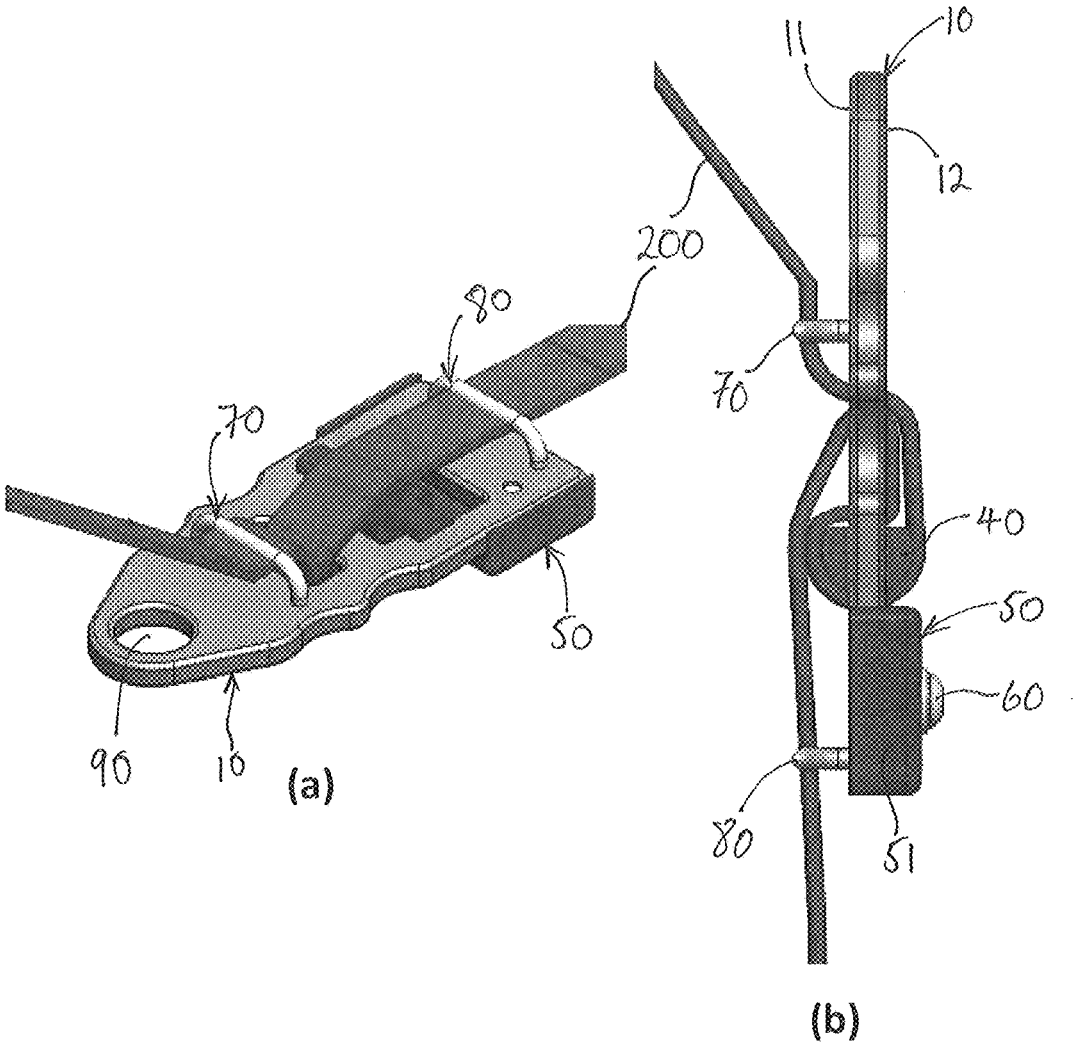
Figure 4:
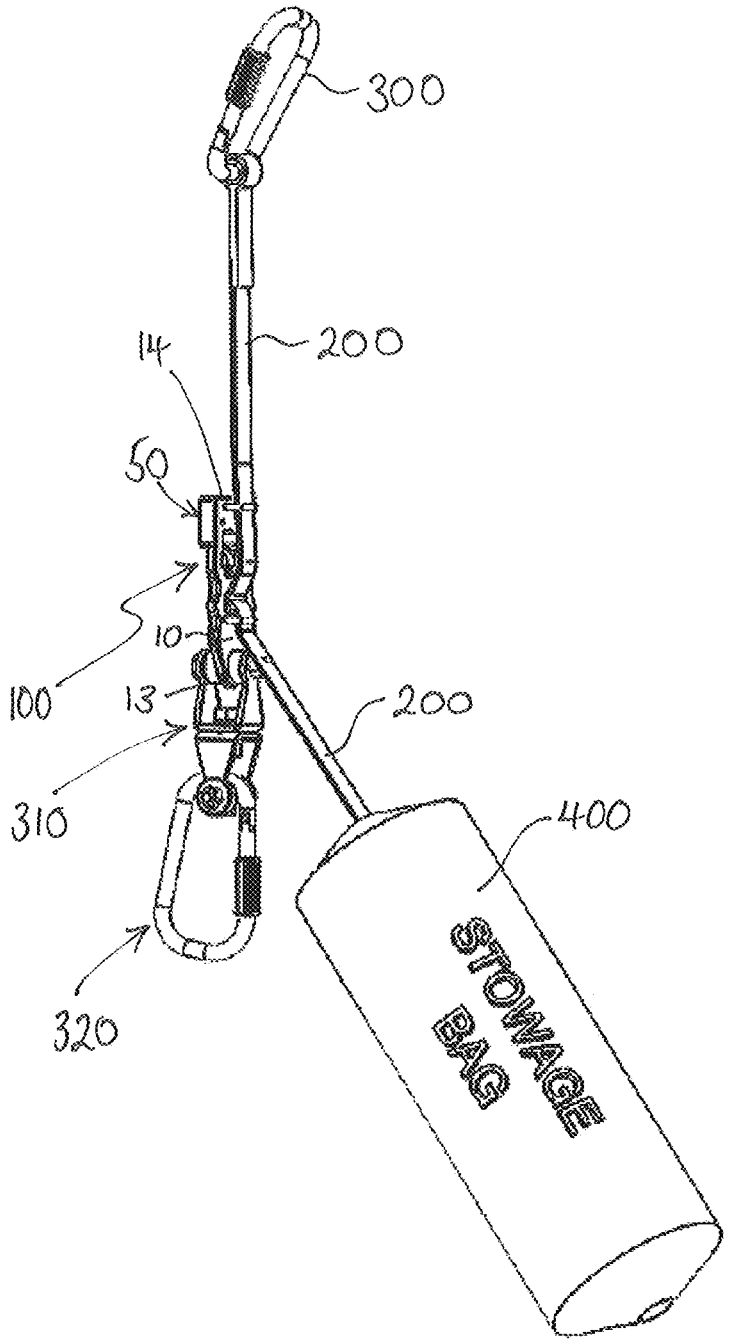

FIG. 3*a* is a perspective view of the device illustrated in FIG. 1, with a tether threaded within the device;

FIG. 3*b* is a side view of the device illustrated in FIG. 1, illustrating the passage of a tether along the device; and, FIG. 4 is a perspective view of the descender device in use.

Figure 2:
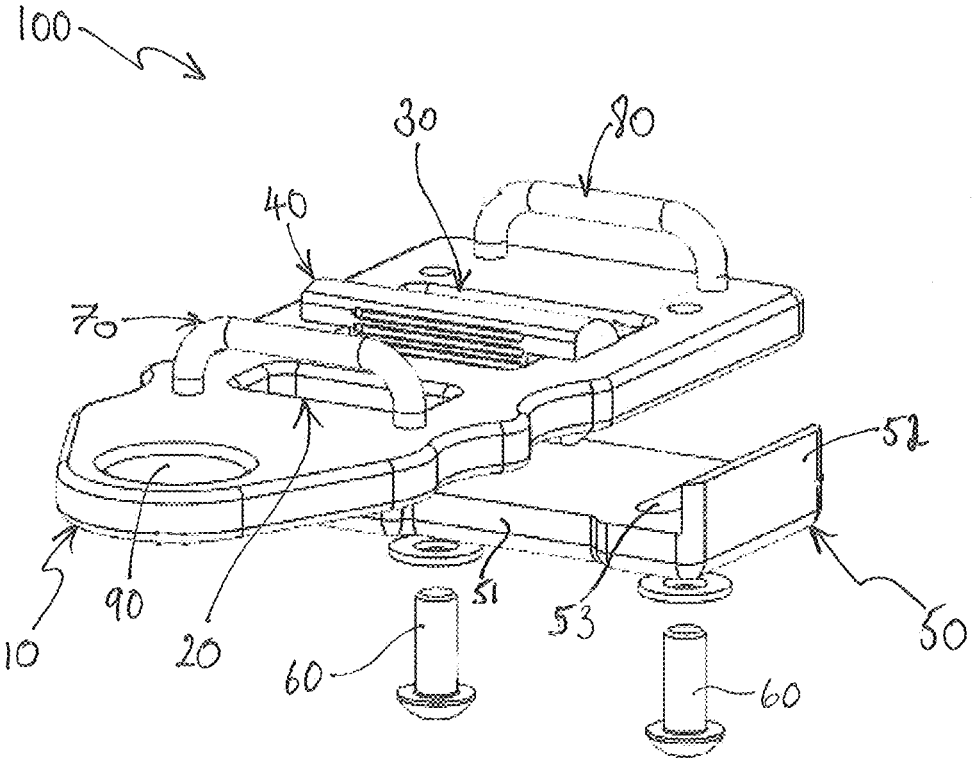
FIG. 2 is an exploded view of the descender device illustrated in FIG. 1.

Referring to FIGS. 1 and 2 of the drawings, there is illustrated a descender device 100 according to an embodiment of the present invention, for enabling controlled descent of a load along a tether 200. The device 100 comprises a substantially planar frame 10 having a first and second aperture 20, 30 disposed therein which are longitudinally separated along the frame 10. The apertures 20, 30 are disposed along a longitudinal axis of the frame 10 and extend through the frame 10 between a front 11 and rear side 12 thereof.

The first aperture 20 is disposed at toward a proximal end 13 of the frame 10 and comprises a substantially rectangular shape. The second aperture 30 is disposed toward a distal end 14 of the frame 10 and similarly comprises a substantially rectangular shape, but the portions of the frame 10 forming the lateral edges 31 of the second aperture 30 are stepped inwardly of the frame 10 to reduce the width of the second aperture 30 at a proximal end 32 thereof.

The device 100 further comprises a control bar 40 which is slidingly coupled within the second aperture 30. The control bar 40 is sized to extend partially beyond the front and rear side 11, 12 of the frame, along the width of the second aperture 30, and comprises a slot 41 formed therein at each longitudinal end thereof for receiving a portion of the frame 10 forming the lateral edges 31 of the second aperture 30. In this respect, the control bar 40 is arranged to slide along the frame 10, within the plane of the second aperture 30. The channels 41 formed in the bar 40 minimise rotation of the bar 40 within the second aperture 30 and thus maintain the orientation of the control bar 40 relative to the frame 10.

The control bar 40 further comprises an outer, longitudinal surface having a first and second portion 42, 43. The first portion 42 is arranged to face the proximal end 32 of the second aperture 30 and comprises a substantially planar side face of the control bar 40, which is orientated substantially transverse to a plane of the frame 10. The first portion 42 comprises a plurality of elongate protuberances 44 formed thereon which serve to grip the tether 200 between the control bar 40 and the portion of the frame forming the proximal end 32 of the second aperture 30. The second surface portion 43 of the control bar 40 comprises a curved surface, whereby the second surface portion 43 comprises substantially half the curved surface of a cylinder.

The device 100 further comprises a control member 50 which is secured to the rear side 11 of the frame 10 toward the distal end 14 thereof. The control member 50 comprises a substantially planar body 51 which extends across the rear side 12 of the frame 10, and side walls 52 which extend substantially transverse to the body, to define a substantially U-shaped cross-section. The control member 50 further comprises a pair of elongate slots 53 (only one of which is illustrated) formed within the body 51, which extend substantially parallel to each other and to the side walls 52, along a portion of the length of the body 51. The slots 53 are arranged to receive a respective fastener 60 for fastening the control member 50 to the rear side 12 of the frame 10. The fasteners 60 separately extend through a respective slot 53 and are coupled to the frame 10 such that the control member 50 can slide along the frame 10 upon the fasteners 60 at the rear side 12 thereof.

The control member 50 is arranged to partially shroud the second aperture 30 at the rear side 12 thereof and the length of the slots 53 are chosen so that the separation of the control bar 40 from a proximal end of the second aperture 32 is limited by a proximal end of the body 51 of the control member 50. In this respect, the control member 50 is arranged to limit the extent to which the control bar 40 can slide toward the distal end 33 of the second aperture 30.

The device 100 further comprises a first and second gate 70, 80 disposed on a front side 11 of the frame 10. The first and second gate 70, 80 comprise an elongate rod 71, 81 or similar which is formed into an arc over a portion of the frame 10, and which extend across the frame 10. The first and second gates 70, 80 are centred upon a longitudinal axis of the frame 10, with the first gate 70 being disposed at a proximal end 13 of the frame 10 and the second gate 80 being disposed at a second end 14 of the frame 10, such that the first and second apertures 20, 30 are disposed between the first and second gates 70, 80.

In use, the device 100 is arranged to enable an operator (not shown) for example, to control their rate of descent along a tether 200. It is envisaged that the device 100 is particularly suited for a tether 200 formed of tubular webbing. The tether 200 is coupled with the device 100 as illustrated in FIGS. 3*a* and 3*b* of the drawings. A free end of the tether 200 is passed through the first gate 70 disposed at the proximal end 13 of the frame 10, along the frame 10 and through the first aperture 20 at a proximal end 21 thereof. The free end of the tether 200 is then passed along the rear side 12 of the frame 10 through the second aperture 30 from the rear side 12 of the frame 10, between the control bar 40 and a distal end 33 of the second aperture 30. The free end is subsequently looped around the control bar 40 and passed out through the second aperture 30 between the first surface portion 42 of the control bar 40 and the proximal end 32 of the second aperture 30. The free end of the tether is then passed back along the rear side 12 of the frame 10, through the first aperture 20 at a distal end 22 thereof, from the rear side 12 of the frame 10 and along the frame 10 through the second gate 80. In this respect it is to be appreciated that the first and second gates 70, 80 guide the tether 200 through the apertures 20, 30 of the device 100.

Referring to FIG. 4 of the drawings, the free end of the tether 200 is then coupled to an anchor point (not shown) via a respective coupling device 300, to support a load (not shown), such as a person secured to the device 100. In this respect, the device 100 may further comprise a support aperture 90 disposed at a proximal end of the frame for coupling with a persons harness (not shown) via one or more swivels 310 and/or karabiners 320, for example. The other free end of the tether 200 may be disposed at a vertical height below the device 100 or held in a stowage bag 400 which may be supported on the persons harness (not shown).

In order to control the rate of descent, the person (not shown) would grip the section of the tether 200 disposed below the device 100, namely the portion of the tether 200 to be passed into the device 100. If the user were to grip the tether 200 tightly, then this will cause the control bar 40 to move toward the proximal end 32 of the second aperture 30 and clamp the tether 200 between the control bar 40 and the proximal end 32 of the second aperture 30. This action would thus arrest the descent of the user along the tether 200. Conversely, if the user (not shown) were to completely let go of the tether 200, then this would result in the tether 200 passing freely around the control bar 400. However, owing to the restricted separation of the control bar 40 from the proximal end 32 of the second aperture 30 by the control member 50, then the rate at which the tether 200 can pass around the control bar 40 and thus pass through the device 100 is limited. The rate at which the tether 200 can pass through the device 100 is pre-set by the positioning of the control member 50 relative to the proximal end 32 of the second aperture 30. The further the control member is situated from the proximal end of the second aperture 30 then the further the control bar 40 can slide along the second aperture 30 and thus the faster the tether 200 can pass through the device 100. It is to be appreciated therefore that positioning of the control member 50 relative to the second aperture 30 can be pre-set according to the weight of the load and/or the use for which the device 100 finds its application.

From the foregoing therefore it is evident that the descender device provides for an effective means of controlling a descent along a tether.

The invention claimed is:

1. A descender device for enabling a controlled descent along a tether, the device comprising a frame having a front and rear side, the frame comprising a first and second aperture disposed therein for receiving a tether, the first and second aperture extending between the front and rear side of the frame, the tether being arranged to pass between the first and second apertures substantially parallel to a longitudinal axis of the frame, the device further comprising a control bar disposed within the second aperture, the control bar extending across the second aperture and constrained to move in a plane of the second aperture, substantially transverse to a longitudinal axis of the bar, wherein in use, the tether is arranged to loop around the control bar within the second aperture and a free ends of the tether are arranged to extend out from the first aperture, away from the front side of the frame, wherein the device further comprises a control member for limiting the extent to which the control bar can slide along the second aperture, the control member having a body and side walls and being slidably coupled to the frame and comprising a pair of elongate slots formed within the body, which extend substantially parallel to each other and to the side walls, along a portion of a length of the body, wherein the control member is arranged to partially shroud the second aperture at the rear side thereof and the length of the slots are chosen so that a separation of the control bar from a proximal end of the second aperture is limited by a proximal end of the body of the control member which is arranged to limit the extent to which the control bar can slide toward a distal end of the second aperture.

2. A descender device according to claim 1, wherein the control member is coupled to the frame at the rear side thereof.

3. A descender device according to claim 1, wherein the control bar is arranged to control the rate at which the tether can pass between the first and second apertures and comprises a plurality of protuberances at a first side thereof, which are arranged to grip the tether between the control bar and a side of the second aperture.

4. A descender device according to claim 3, wherein the first side of the control bar faces the first aperture.

5. A descender device according to claim 3, wherein the control bar further comprises a second side which faces away from the first aperture, the second side comprising a curved surface.

6. A descender device according to claim 1, further comprising a first and second gate disposed proximate the first and second apertures, respectively.

7. A descender device according to claim 6, wherein the first and second apertures are disposed longitudinally of the frame between the first and second gates.

8. A descender device according to claim 6, wherein the first and second gates are disposed at the front side of the frame and are arranged to separately receive one end of the tether.

9. A descender device according to claim 1, wherein the first and second apertures are disposed upon the longitudinal axis of the frame.

10. A descender device according to claim 1, further comprising a support aperture for coupling the device to a load to be supported.

11. A descender device according to claim 4, wherein the control bar further comprises a second side which faces away from the first aperture, the second side comprising a curved surface.

12. A descender device according to claim 7, wherein the first and second gates are disposed at a front side of the frame and are arranged to separately receive one end of the tether.

* * * * *